US006419506B2

(12) United States Patent
Jones et al.

(10) Patent No.: US 6,419,506 B2
(45) **Date of Patent: *Jul. 16, 2002**

(54) COMBINATION MINIATURE CABLE CONNECTOR AND ANTENNA

(75) Inventors: Jeffrey L. Jones, Orem; David Oliphant, West Valley City; David Andrus, Provo; Sy Prestwich, West Jordan, all of UT (US)

(73) Assignee: 3Com Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/488,668

(22) Filed: Jan. 20, 2000

(51) Int. Cl.[7] ..... H01R 13/44
(52) U.S. Cl. ..... 439/131; 343/702
(58) Field of Search ..... 439/131, 946, 439/676; 343/702, 906

(56) References Cited

U.S. PATENT DOCUMENTS 4,611,186 A * 9/1986 Ziegner ..... 333/246
5,727,972 A * 3/1998 Aldous et al. ..... 439/655
5,773,332 A * 6/1998 Glad ..... 439/344
5,933,116 A 8/1999 Suesada et al. ..... 343/702
5,973,652 A 10/1999 Sanford et al. ..... 343/781
6,031,493 A * 2/2000 Tsuda et al. ..... 343/702
6,033,240 A * 3/2000 Goff ..... 439/131
6,078,259 A * 6/2000 Brady et al. ..... 340/572.7
6,081,243 A * 6/2000 Lake ..... 343/873
6,147,650 A * 11/2000 Kawahata et al. ..... 343/700
6,160,515 A * 12/2000 McCoy et al. ..... 343/702
6,172,645 B1 * 1/2001 Hollander et al. ..... 343/702
6,172,646 B1 * 1/2001 Kawahata et al. ..... 343/702
6,177,908 B1 * 1/2001 Kawahata et al. ..... 343/700
6,259,418 B1 * 7/2001 Jones et al. ..... 343/846

* cited by examiner

*Primary Examiner*—Brian Sircus
*Assistant Examiner*—Thanh-Tam Le

(57) ABSTRACT

The present invention relates to an antenna which is physically combined with a physical/electrical media connector. Some embodiments of the present invention may be configured with connectors which can accommodate RJ-11 or RJ-45 plugs allowing devices equipped with these connectors to utilize cable connections as well as wireless connections via the combined antenna. Some embodiments of the present invention comprise antennas which hinge or otherwise deploy from the combined connector/antenna unit and some embodiments include automatic activation of wireless circuitry when the antenna is deployed. Certain embodiments also comprise units with particular antenna and ground plane configurations.

29 Claims, 14 Drawing Sheets

COMBINATION MINIATURE CABLE CONNECTOR AND ANTENNA

THE FIELD OF THE INVENTION

The present invention relates to small scale antennas embodied in physical/electrical media connectors used in the computer and communications industry. More particularly, the present invention relates to an antenna which can be constructed as part of a thin profile physical/electrical media connector. This type of antenna is useful in combination electronic devices which utilize both wireless and wired communications networks.

BACKGROUND

Some standards in the electrical connector industry have been created by government regulation such as the Federal Communications Commission's Title 47, §68.500, otherwise denoted "Subpart F—Connectors" (Subpart F). Subpart F is incorporated herein by reference. Subpart F contains detailed specifications for "miniature" connectors used in the communications industry. Included in this specification are the "Miniature 6-position plug and jack" and the "Miniature 8-position plug and jack." These connectors, commonly known as the RJ-11 connector and the RJ-45 connectors, respectively, are ubiquitous throughout the industry.

The miniature 6-position connector or RJ-11 has emerged as the industry standard connector for telephone lines. RJ-11 plugs and jacks are used on almost all telephone sets for connection to the phone system and consequently are used for standard modem connections which also use these telephone lines. Although most telephone companies use only 4 or 2 of the available positions on the connector, the 6-position connector is the standard.

The miniature 8-position connector or RJ-45 has become an industry standard connector for computer networks. It is used for inter-connectivity between network adapter cards, hubs, routers, switches and other network hardware.

These connectors have been the industry standard for many years and are likely to remain so in the future for telephones, desktop computer modems and network adapters, and other substantially stationary communications equipment. However, hardware technology and the "miniaturization" of components has progressed to the point that the standard, "miniature" RJ connectors have a larger cross-section than the thickness of the hardware to which they connect.

An example of these smaller, thin profile hardware configurations is the PC Card Standard promulgated by the Personal Computer Memory Card International Association (PCMCIA). The PCMCIA PC Card standard identifies three primary card type designations: Type I, II and III. These type designations correspond to physical dimension restrictions or "form factors" of 85.6 mm (length)×54.0 mm (width) and thicknesses of 3.3 mm, 5.0 mm and 10.5 mm respectively. These thin profile expansion cards are used to expand the functionality of computers and related products by adding circuitry contained on the card to the host device. Host devices, such as laptop computers, contain expansion slots which receive the expansion cards and provide electrical connections thereto. Modems and network adapters are often constructed in PC Card standard form factor.

As a consequence of hardware miniaturization in the face of a nearly worldwide RJ connector standard, hardware manufacturers have developed myriad proprietary hardware connection standards and an assortment of connectors and adapters that allow the RJ plugs to be connected to thin profile hardware.

One elegant and convenient connector which allows connection of the standard RJ type plug with thin profile hardware is the XJACK® produced by 3Com Corporation, Salt Lake City, Utah. The XJACK®, shown generally in FIG. 1, is a thin profile connector designed to be contained within hardware such as PC Card standard compliant devices. The XJACK® comprises a thin body 1 with an aperture 3 therein for receiving a standard RJ connector plug 5 such as a miniature 6-pin plug, a miniature 8-pin plug or some other connector. Jack conductors 7 contact plug conductors 9 just as a conventional RJ jack connects. The XJACK® may be retractable within the device or be detachable therefrom. Commonly used XJACK® connectors retract in and out of a device by sliding along a track. A spring is often used to bias the XJACK® connector such that it pops out of its retracted state and remains extended during use.

Wireless communication devices are now becoming commonplace in the electronics industry. Wireless networking of portable computers and associated devices is now replacing a large segment of the networking market. Wireless communication devices including wireless networking adapters, hubs and other equipment utilize radio transmitters and receivers to transmit data signals from one device or node to another. These radio transmitters and receivers must utilize a specific frequency band and protocol to accomplish this task. Since these wireless networks and communications areas may often overlap, standards, protocols and privacy protection are necessary. One current standard in the industry has been established by the Institute of Electrical and Electronics Engineers, Inc. (IEEE) and is known as IEEE 802.11. This standard comprises communications standards, protocol and equipment specifications for wireless communication equipment including privacy and encryption provisions.

Another emerging standard in wireless communications and networking, known as Bluetooth®, is being established by a collaborative group of communications and computing companies. Devices incorporating Bluetooth® technology will utilize a micro-chip transceiver for communications between devices. Bluetooth® devices will transmit in the previously unused 2.4 GHz range. Bluetooth® technology promises to be a viable and economical networking solution for interconnection of cell phones, computers, printers, modems, computer peripherals, fax machines and other communications and computing devices. The size of the Bluetooth® transceiver will make it usable in devices as small as palm computers and cell phones.

Antennas are well known for enabling and improving transmission to radio receivers and from radio transmitters. Antennas can dramatically increase the range of radio transceivers, however most antenna designs function best when protruding from their host device. In small electronic devices protruding antennas are often vulnerable to breakage as the devices are often stowed in purses, pockets, backpacks and other areas where neglect can occur. A retractable antenna is more convenient and durable and occupies less space when retracted.

Conventionally retractable antennas often occupy too much space to be combined with other physical/electrical media connectors in a thin profile device or expansion card. The limited space in these devices often precludes the combination of wireless elements with antennas and other wired devices which require cable connectors.

While wireless technology is fast replacing a large segment of the communications and networking industry, wired equipment is still prevalent. A communications or computing device, such as a portable computer, which can connect to both wireless and conventionally wired networks will be more adaptable and convenient at the present time. A device or expansion card which provides connectivity to both wired and wireless technology is extremely useful.

SUMMARY AND OBJECTS OF THE INVENTION

The present invention relates to antennas which are physically combined with standard cable connectors on electronic devices. Many electronic apparatus comprise physical/electrical media connectors which are used to connect to communications networks such as telephone networks or computer networks. This is often done by connecting a telephone or network cable to the connector on the apparatus. Some apparatus of the present invention comprises an antenna physically combined with a retractable, thin profile cable connector.

Wireless communications devices are becoming extremely common especially in the fields of telephone communications and computer network communications. Wireless local area networks (LAN's) and even wide area networks (WAN's) are now widespread. Because portable computing devices may need to interface with both wireless and conventional wired networks, a combination network adapter or modem which accommodates both wired and wireless communications can be useful. These combination devices must sometimes fit into a device with a very small form factor or thin profile. Consequently, space for both a wired connector and a separate antenna is often difficult to find. Embodiments of the present invention comprise an antenna which is combined with a cable connector on a device and which obviates the need for a physically separate antenna on the device.

Some embodiments of the present invention also comprise a ground plane which may be built into the cable connector itself or into a component of the antenna which is a part of the cable connector. For example, and not by way of limitation, an XJACK® or other retractable thin profile jack may be constructed with a ground plane element therein to enhance antenna performance.

Some embodiments of the present invention comprise hinges or other movable parts which may be used to deploy the antenna from a retracted or folded position to a position that will improve reception and performance. For example, and not by way of limitation, an antenna may hinge from a position which fully or partially falls within the form factor of the cable connector to an upright position for improved performance.

Some embodiments of the present invention may also comprise switching circuitry which automatically activates or switches to a wireless device when the antenna is deployed. When the antenna is deployed, the device switches to its wireless circuitry. For example, and not by way of limitation, a combination wireless network adapter and wired network adapter may be contained in a single expansion card. When the antenna is deployed, the circuitry automatically activates the wireless adapter and when the antenna is stowed, the wired adapter is activated. The same principle may be used for a wired/wireless modem combination.

Certain embodiments of the present invention may also comprise a "modified monopole" antenna. The modified monopole antenna has a radiating element which typically protrudes substantially vertically from a ground plane element and curves away from device circuitry then curves back toward the vertical forming a shape that may be angular or curved. The shape has been found to improve antenna performance from that of a strictly vertical antenna located at the edge of a ground plane. The shape allows the antenna to protrude from near the center of the ground plane element and then curve away from device circuitry which may produce interference. The antenna typically terminates in a substantially vertical direction.

Accordingly, it is an object of some embodiments of the present invention to provide an antenna which is physically combined with conventional cable connectors.

It is also an object of some embodiments of the present invention to provide an antenna which can be combined with thin profile devices without substantially increasing space requirements.

It is another object of some embodiments of the present invention to provide a thin profile combination electronic device which can be used with both wired and wireless communications networks.

These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the system and apparatus of the present invention, as represented in FIGS. 1 through 13C, is not intended to limit the scope of the invention, as claimed, but it is merely representative of the presently preferred embodiments of the invention.

The currently preferred embodiments of the present invention will be best understood by reference to the drawings, wherein like parts are designated by like numerals throughout.

The Personal Computer Memory Card International Association (PCMCIA) promulgates the PC Card Standard for thin profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type designation. Type I, II, and III PC Cards have thicknesses of 3.3 mm, 5.0 mm and 10.5 mm respectively. Any references to the PC Card Standard or PCMCIA card standard refer to electronic cards substantially conforming to this standard as described herein.

The term miniature modular jack, physical/electrical media connector, fixed jack, XJACK®, alligator jack, cable connector and the like, connotes a media connector that may have qualities such as those connectors having physical attributes described in F.C.C. Part 68, Subpart F. Specific terms such as RJ-type, RJ-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors.

Figure 1:
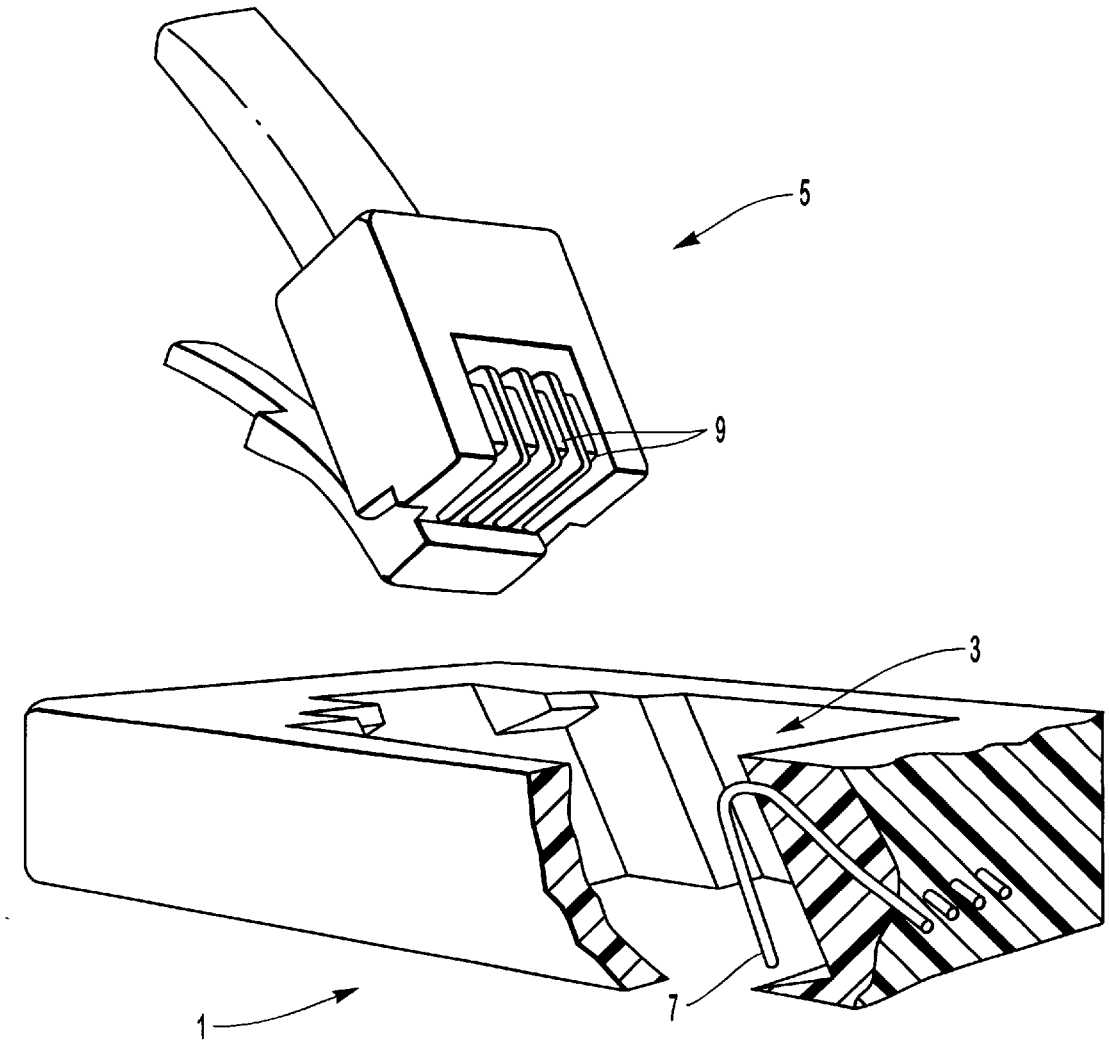
FIG. 1 (PRIOR ART)
FIG. 1 is a perspective view of a prior art XJACK® cable connector.
Figure 2:
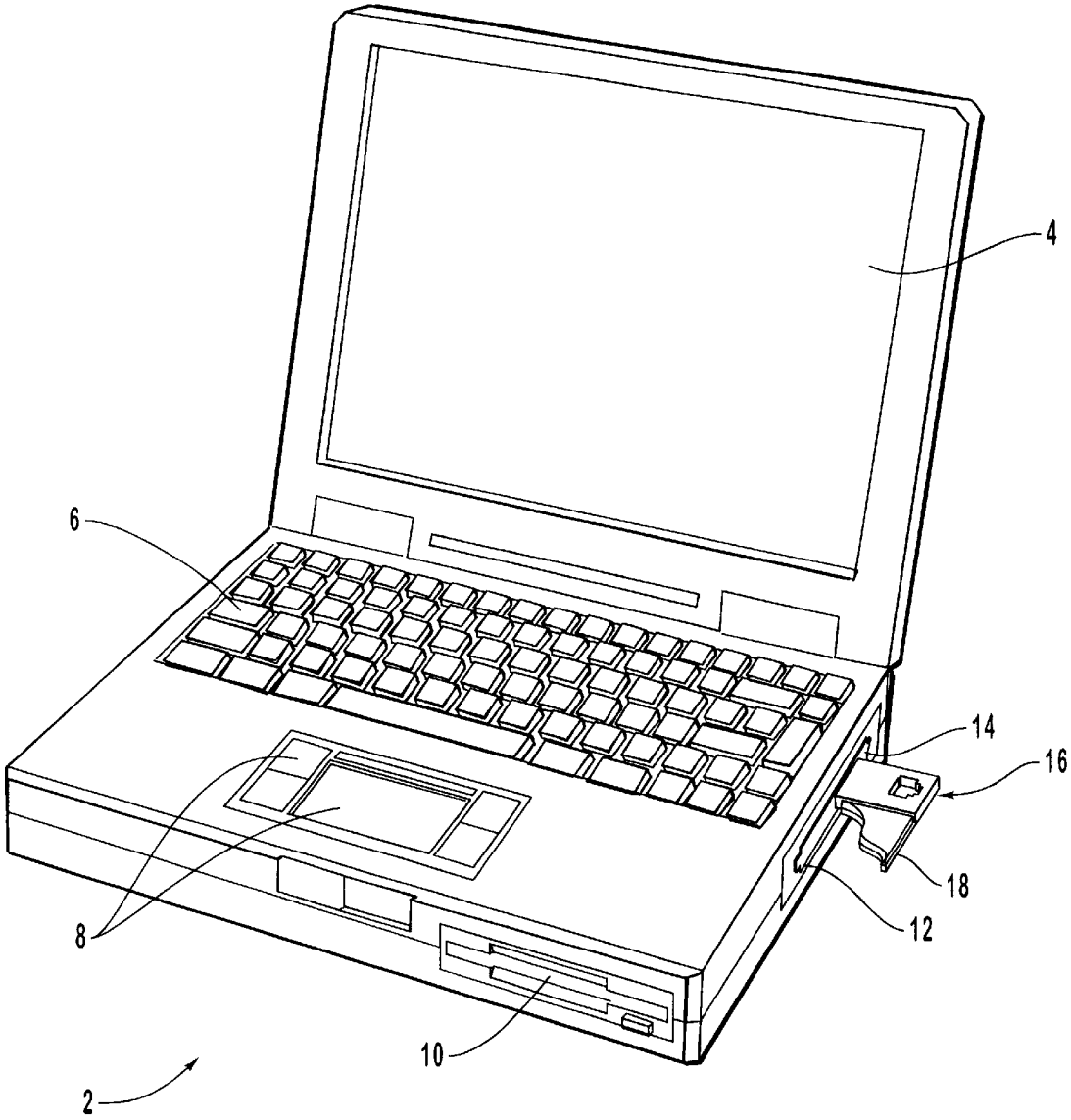
FIG. 2 is a perspective view of a portable computing device containing an expansion card slot filled with an expansion card comprising a retractable embodiment of the present invention.

In reference to FIG. 2, an embodiment of the present invention is shown as it may be used in a portable computing device. Portable computing device 2 has a keyboard 6, pointing device 8, display 4, and disk drive or other media reader or writer 10 as are well known in the art. Computing device 2 also contains an expansion card slot 12 such as a PC Card standard expansion slot. Within slot 12 is an expansion card 14 which comprises a novel combination antenna and physical/electrical media connector 16 of the present invention. Expansion cards 12 which are typically integrated with the novel combination antenna and cable connector of the present invention are generally combination devices which utilize both wireless and wired technology.

Figure 3A:
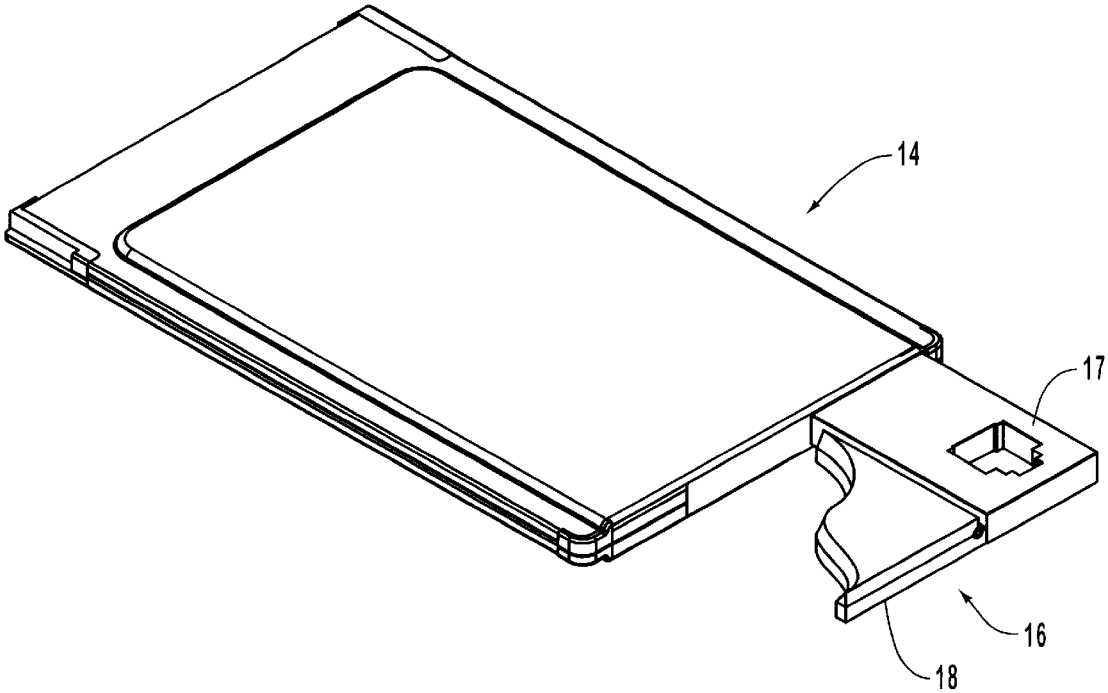
FIG. 3A is a perspective view of an electronic expansion card containing a retractable embodiment of the present invention in an extended position.
Figure 3B:
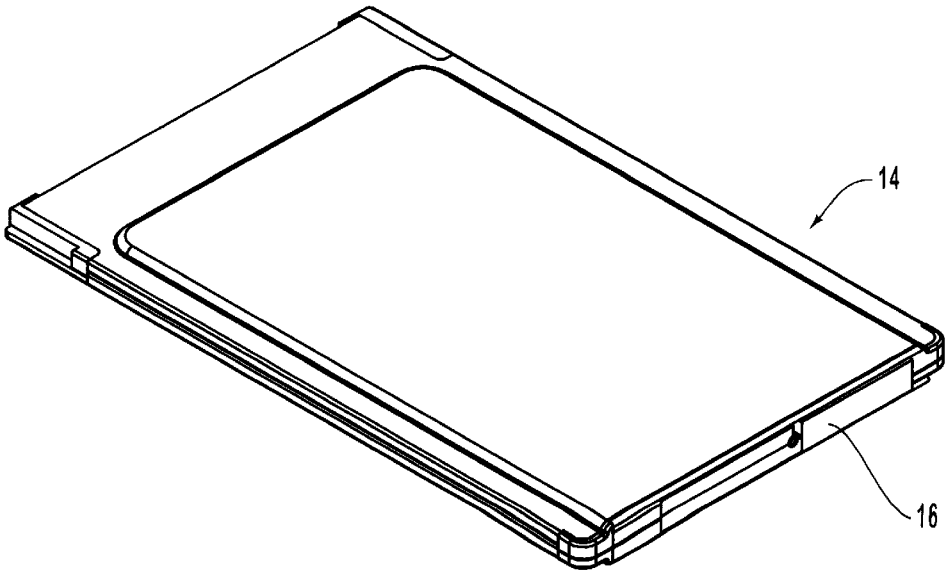
FIG. 3B is a perspective view of an electronic expansion card containing a retractable embodiment of the present invention in a retracted position.

An expansion card embodiment of the present invention is shown in FIG. 3A where expansion card 14 comprises a novel retractable extension 16 which comprises a combination physical/electrical media connector 17 and antenna 18. When the connector and antenna are not needed extension 16 may be retracted (as shown in FIG. 3B) to save space and protect extension 16. Expansion card 14 may conform to the PC Card standard form factor or other thin profile formats.

Figure 4:
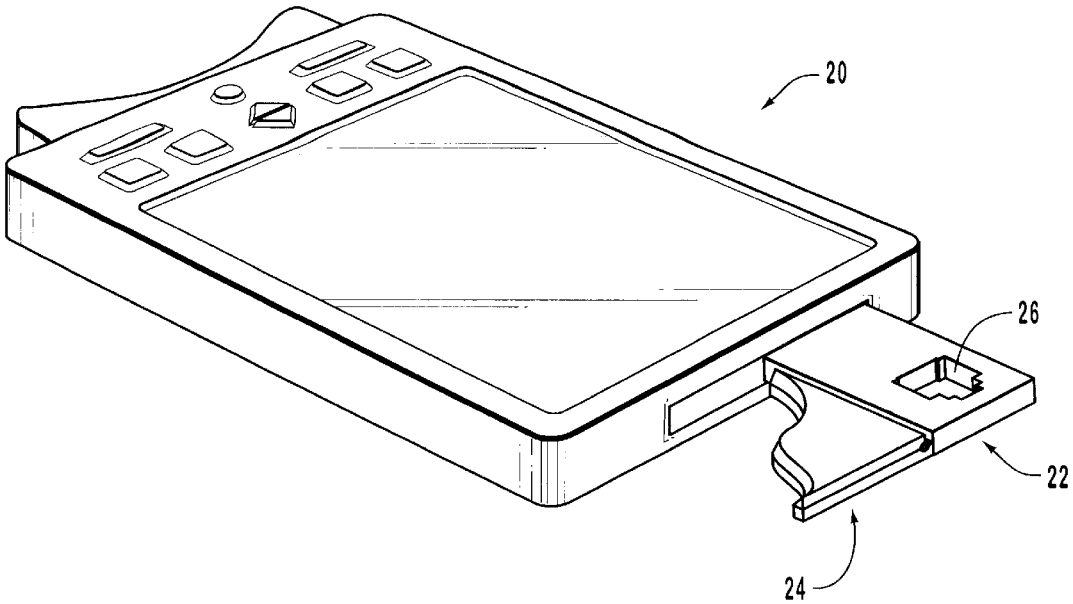
FIG. 4 is a perspective view of a thin profile palm computing device comprising an embodiment of the present invention in an extended position.
Figure 5:
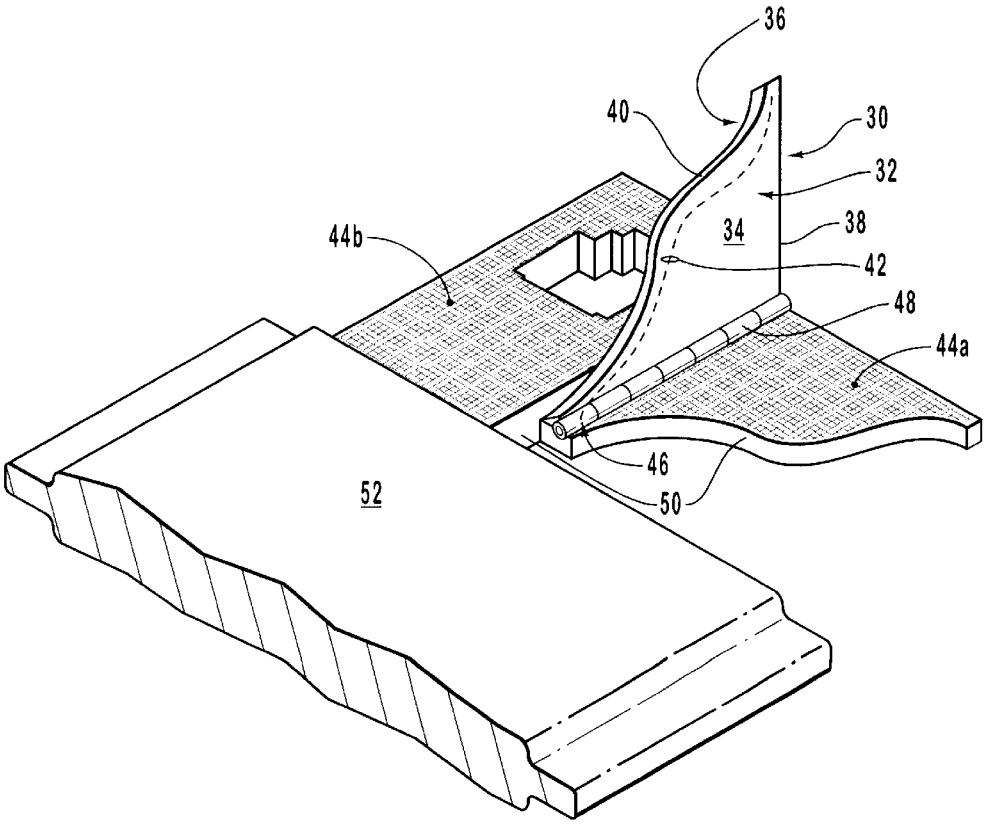
FIG. 5 is a perspective view of an embodiment of the present invention comprising an adjacently located cable jack and a hinged modified monopole antenna.

Another embodiment of the present invention, as shown in FIG. 4, is contained in a small and portable computing device such as a palm computing device 20. Retractable extension 22 may be extended to expose antenna 24 and cable connector 26 for connection to various networks and systems or extension 22 may be retracted to make computing device 20 more compact. Embodiments of the present invention may be incorporated within or may comprise expansion cards, computing devices, communications devices and other apparatus.

Many embodiments of the present invention may comprise a "modified monopole" type antenna 18, 24 and 30. In reference to FIG. 5, the modified monopole antenna generally comprises a thin "fin" 32 with two substantially planar surfaces 34 and 36. Planar surface 36 is opposite surface 34 and not shown in FIG. 5. Surfaces 34 and 36 are connected by a substantially vertical edge 38 on one side and a curved, reverse-curved or angled edge 40 on the other side. Within fin 32 is a radiating element 42. Fin 32 is generally composed of a lightweight and durable non-conductive material such as many plastic materials. Typically, the modified monopole antenna will operate in conjunction with ground plane elements 44A and 44B against which it may radiate. Ground plane elements 44A and 44B are generally disposed within the structure of extension 50. Preferably, ground plane elements 44A and 44B are disposed such that radiating element 42 will extend from a point near the center of the area occupied by ground plane elements 44A and 44B, however some embodiments have been found to operate effectively without a centrally located radiator.

In a preferred embodiment of the modified monopole antenna, the radiating element 42 extends in a substantially vertical direction from a substantially central location 46 on ground plane elements 44A and 44B. After this initial vertical extension, radiating element 42 curves, bends, angles or is otherwise redirected in a direction away from circuitry in host device 52. The radiating element 42 typically terminates by bending back toward a substantially vertical direction. It should be noted that radiating element 42 may or may not follow the profile of edge 40. The centroidal position on the ground plane and the redirection of the antenna radiator away from device circuitry may provide improved antenna performance and reduced interference when compared with a similar antenna with a radiator located at the edge of its ground plane. The base of antenna 30 may comprise a hinge 48 or other means for orienting antenna 30. Orientation in a substantially vertical direction generally increases antenna performance, however, most thin profile devices have a rather flat form factor requiring an internal or retractable antenna to be reoriented from a position within the device to a usable, more vertical position outside the device.

Figure 6A:
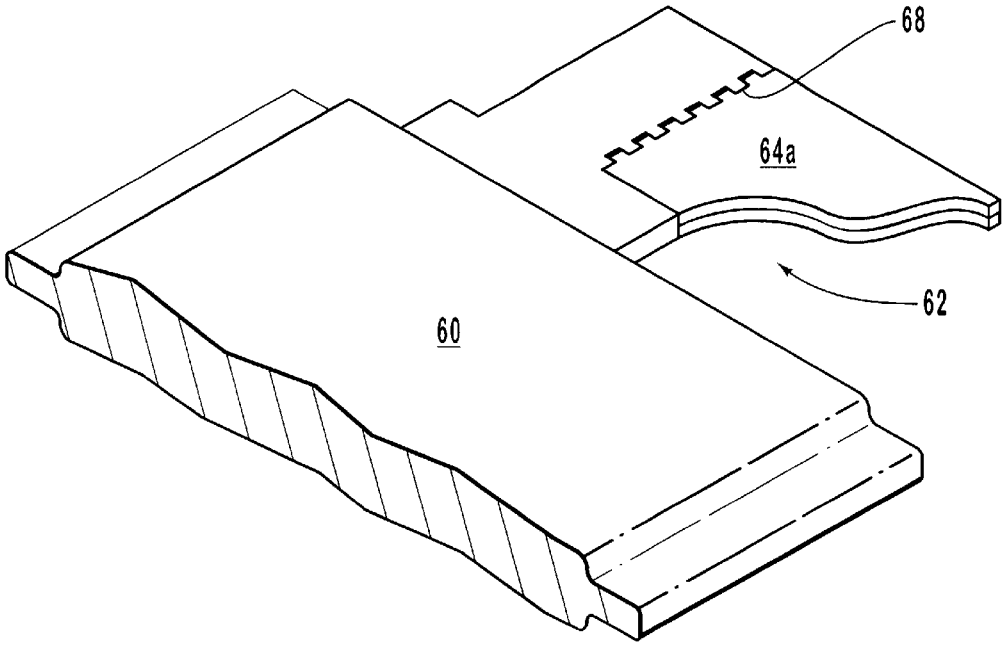
FIG. 6A is a perspective view of an embodiment of the present invention comprising a cable jack located below a hinged modified monopole antenna in a stowed position.
Figure 6B:
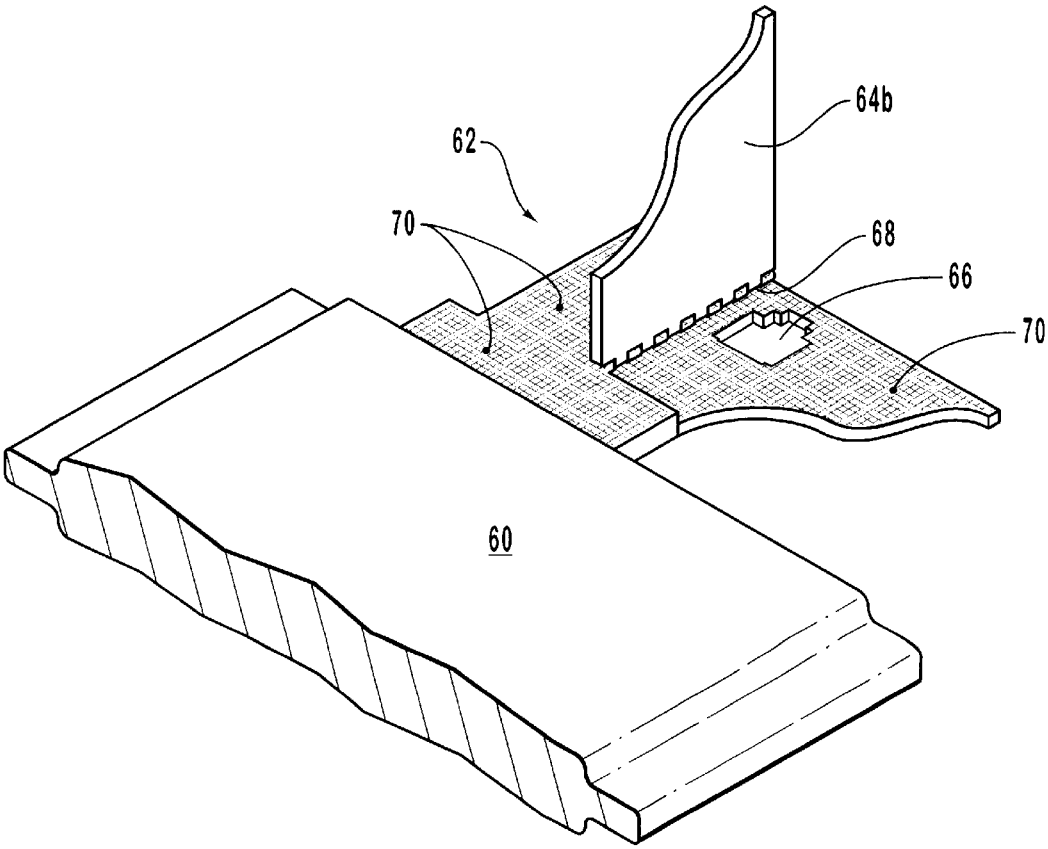
FIG. 6B is a perspective view of an embodiment of the present invention comprising a cable jack located below a hinged modified monopole antenna in a deployed position.

In reference to FIGS. 6A and 6B, a first embodiment of the present invention comprises a combination electronic apparatus 60 with wireless circuitry and cable-connected circuitry. A retractable extension 62 is mounted in apparatus 60 such that extension 62 may be retracted into apparatus 60 or extended to a position exterior to apparatus 60. When in an extended position, as shown in FIGS. 6A and 6B, extension 62 is exposed so that elements thereon may be accessed or given access to the exterior environment. Extension 62 comprises an antenna 64*a* and 64*b* and a physical/electrical media connector or cable connector 66.

In this embodiment, when extension 62 is first extended, antenna 64*a* is in a stowed position which allows for convenient storage in apparatus 60 when extension 62 is retracted. However, this stowed position does not allow for optimum antenna orientation and reception. Therefore, antenna 64*a* and 64*b* comprises a hinge 68 which allows antenna 64*a* and 64*b* to be reoriented from a horizontal stowed position 64*a* to a substantially vertical, deployed position 64*b* for improved performance.

When antenna 64*b* is deployed, physical/electrical media connector or cable connector 66 is exposed allowing for connection to conventional wired communications networks such as, but not limited to, telephone networks or computer networks.

Extension 62 may also comprise ground plane elements 70 within its structure to improve antenna performance. Additionally, extension 62, may comprise impedance matching circuitry to enhance antenna performance and compatibility.

Figure 7A:
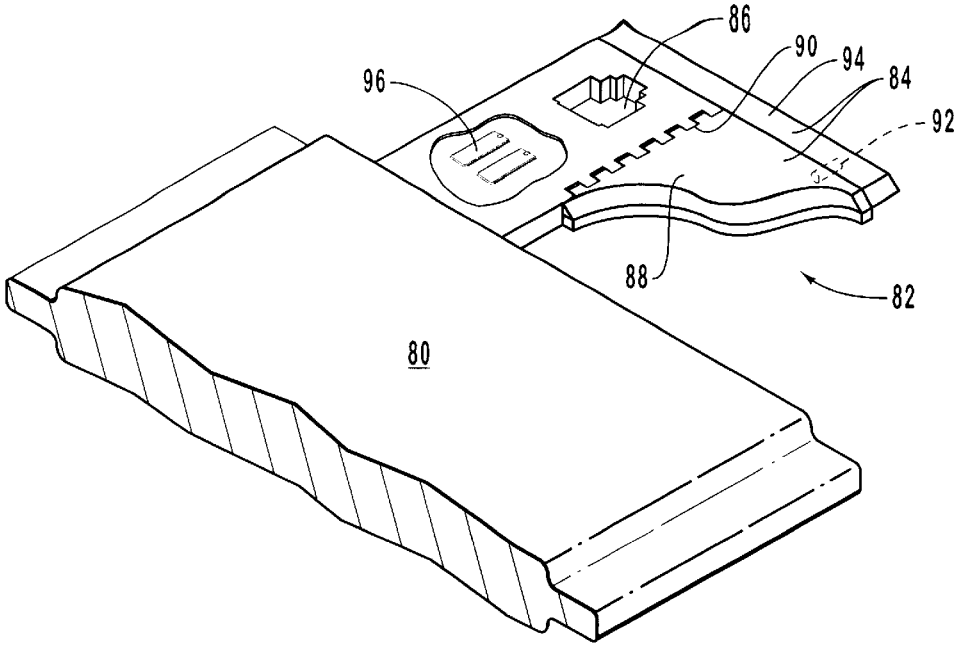
FIG. 7A is a perspective view of an embodiment of the present invention comprising an adjacently located cable jack and a hinged modified monopole antenna with hinged secondary antenna extension in a stowed position.
Figure 7B:
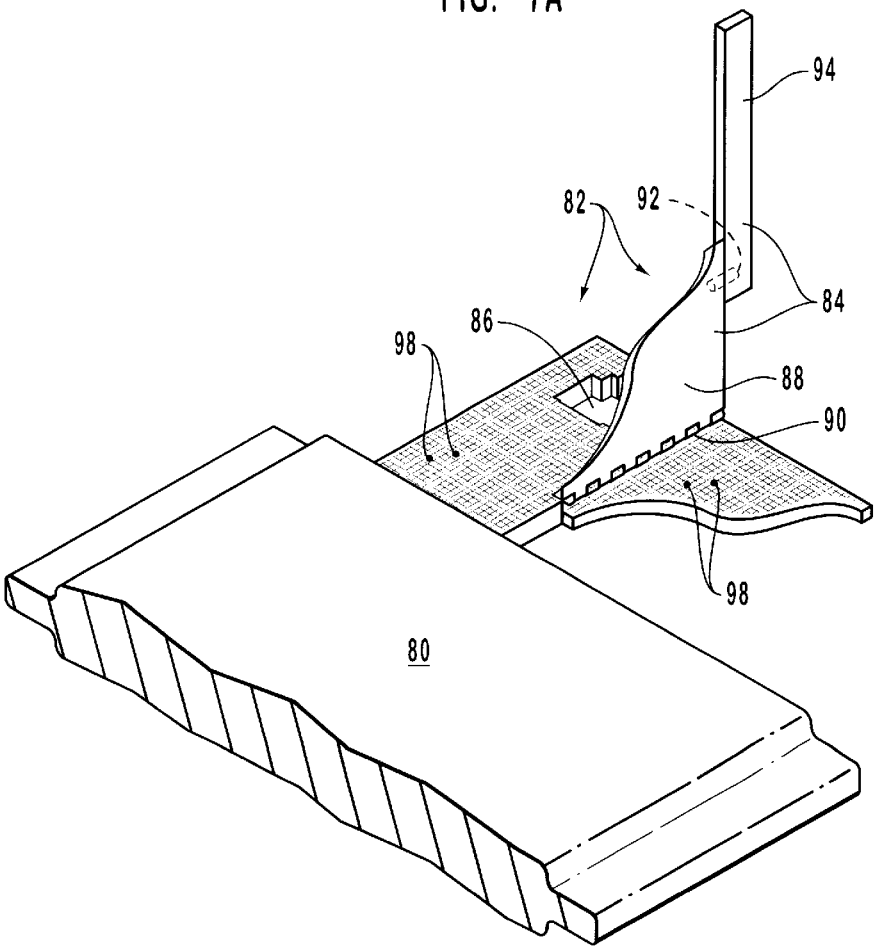
FIG. 7B is a perspective view of an embodiment of the present invention comprising an adjacently located cable jack and a hinged modified monopole antenna with hinged secondary antenna extension in a deployed position.

A second embodiment of the present invention, shown in FIGS. 7A and 7B, may comprise a combination wireless/wired electronic apparatus such as combination expansion card 80 from which electronic extension 82 may extend. Extension 82 comprises a multiple-hinged antenna 84 and a physical/electrical media connector or cable connector 86. Antenna 84 may be deployed or reoriented to a substantially vertical position by folding antenna base fin 88 along hinge 90 so that fin 88 rests in a substantially vertical position. Deployment is completed by subsequently rotating antenna tip 94 about hinge pin 92 until antenna tip 94 reaches an extended and substantially vertical position. Antenna 84 may be stowed by folding in a reverse procedure. This embodiment allows access to cable connector 86 at any time while antenna 84 is stowed or deployed so long as extension 80 is extended. Antenna tip 94 may comprise a chip antenna which may or may not require ground plane elements for optimal performance.

Extension 82 of this second embodiment may also comprise ground plane elements 98 and internal circuitry 96 such as impedance matching circuitry.

Figure 8A:
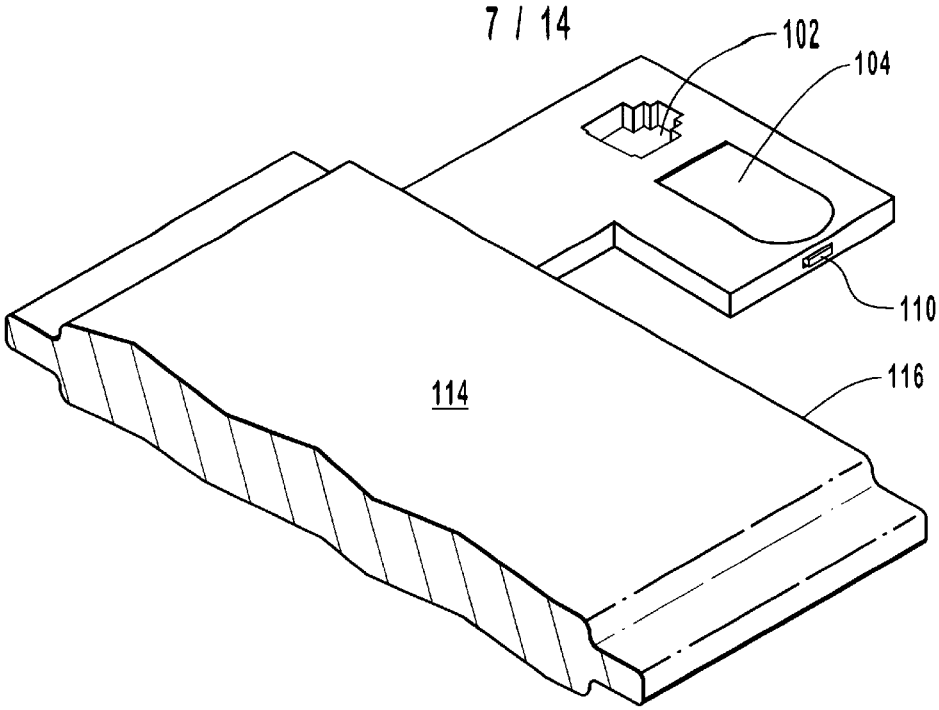
FIG. 8A is a perspective view of an embodiment of the present invention comprising an adjacently located cable jack and a hinged antenna which hinges parallel to the end of the device from which it extends with antenna in a stowed position.
Figure 8B:
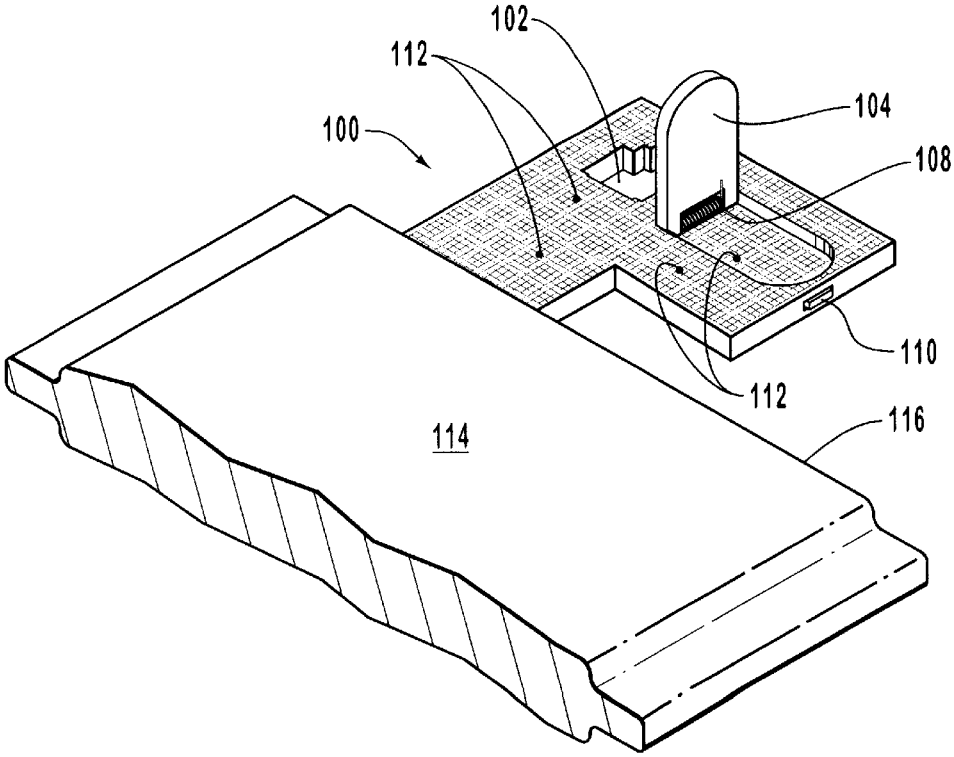
FIG. 8B is a perspective view of an embodiment of the present invention comprising an adjacently located cable jack and a hinged antenna which hinges parallel to the end of the device from which it extends with antenna in a deployed position.

A third embodiment of the present invention, shown in FIGS. 8A and 8B comprises an extension 100 comprising a physical/electrical media connector or cable connector 102 and a deployable antenna 104. Antenna 104 may be deployed to a vertical position once extension 100 has been extended. Deployment of antenna 104 is enabled through a spring-loaded hinge 106. Spring 108 acts to bias hinge 106 to an open or deployed position. Antenna 106 deployment may be achieved by a manual release method effectuated by pressing release button 110 or it may be achieved automatically as extension 100 is extended. Deployment of antenna 104 may also activate switching circuitry which activates a wireless device or another electronic device as antenna 104 is raised. In this third embodiment of the present invention, antenna 104 is configured to hinge from a point substantially central to ground plane elements 112 in extension 100. To achieve this central location, antenna 104 is hinged to swing along an arc that is parallel to the adjacent edge 116 of host device 114.

Figure 8C:
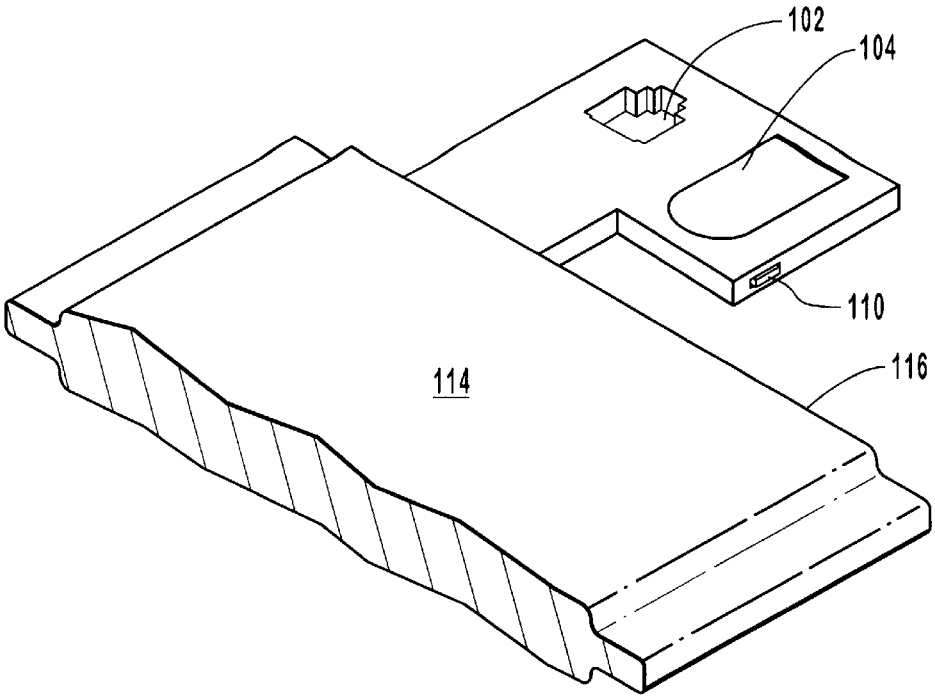
FIG. 8C is a perspective view of an embodiment of the present invention comprising an adjacently located cable jack and a hinged antenna which hinges perpendicular to the end of the device from which it extends with antenna in a stowed position.
Figure 8D:
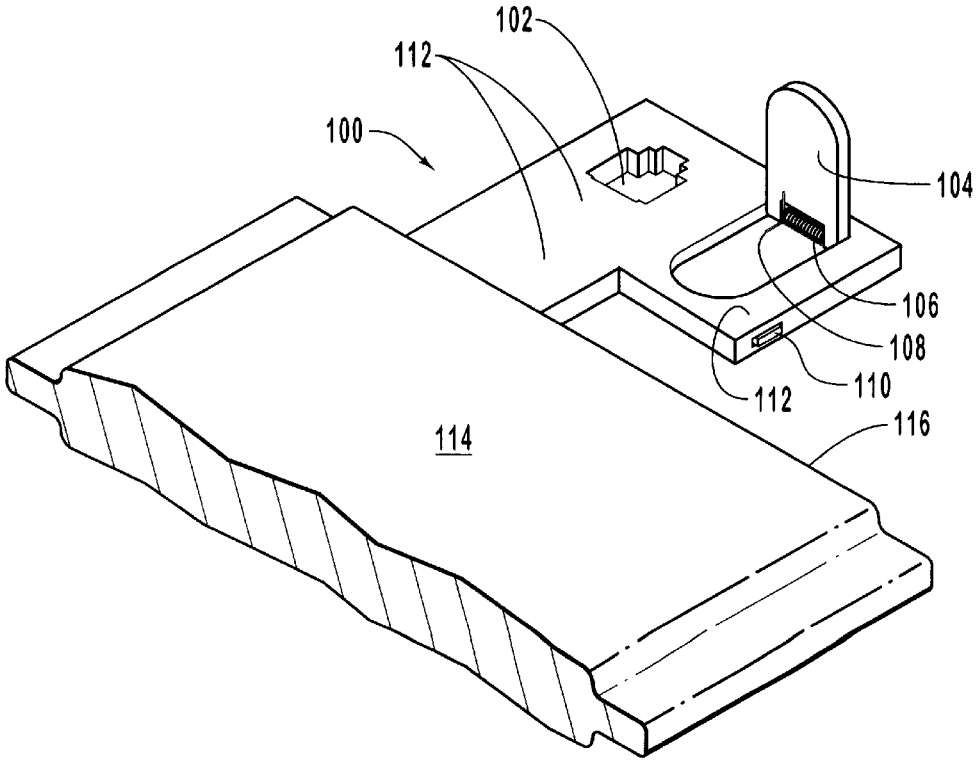
FIG. 8D is a perspective view of an embodiment of the present invention comprising an adjacently located cable jack and a hinged antenna which hinges perpendicular to the end of the device from which it extends with antenna in a deployed position.

A fourth embodiment of the present invention, shown in FIGS. 8C and 8D is similar to the third embodiment except that antenna 104 is hinged from a point distal to host device 114 and in a manner that swings antenna 104 along an arc that is perpendicular to the adjacent edge 116 of host device 114. Depending on frequency and design constraints, a distal location may help eliminate interference from circuitry in host device 114.

Figure 9A:
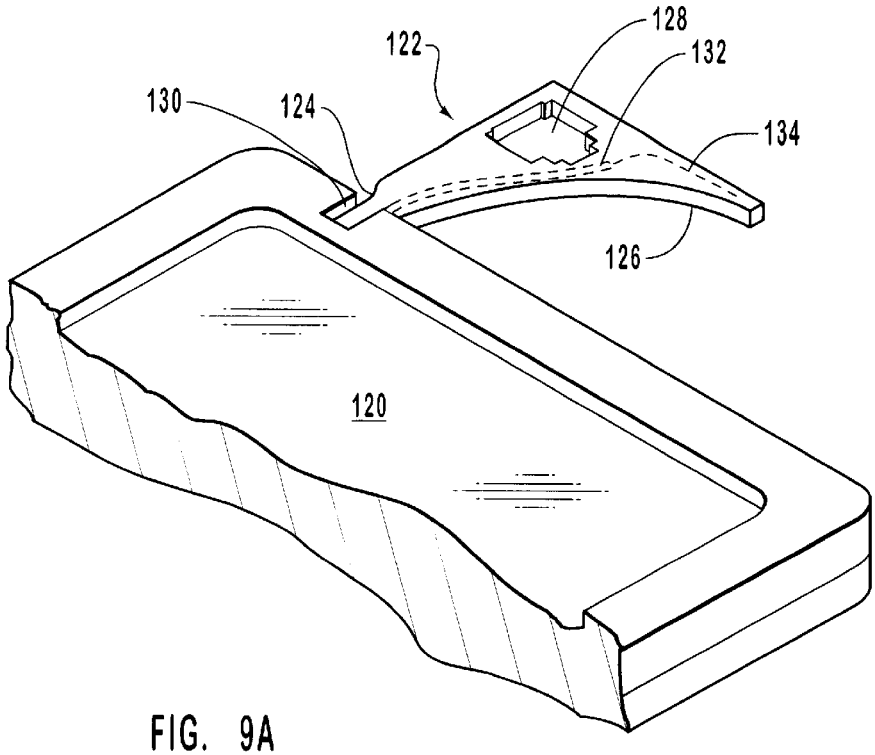
FIG. 9A is a perspective view of a palm computing device with an embodiment of the present invention comprising a swivel mounted antenna with integral cable connector in a stowed position.
Figure 9B:
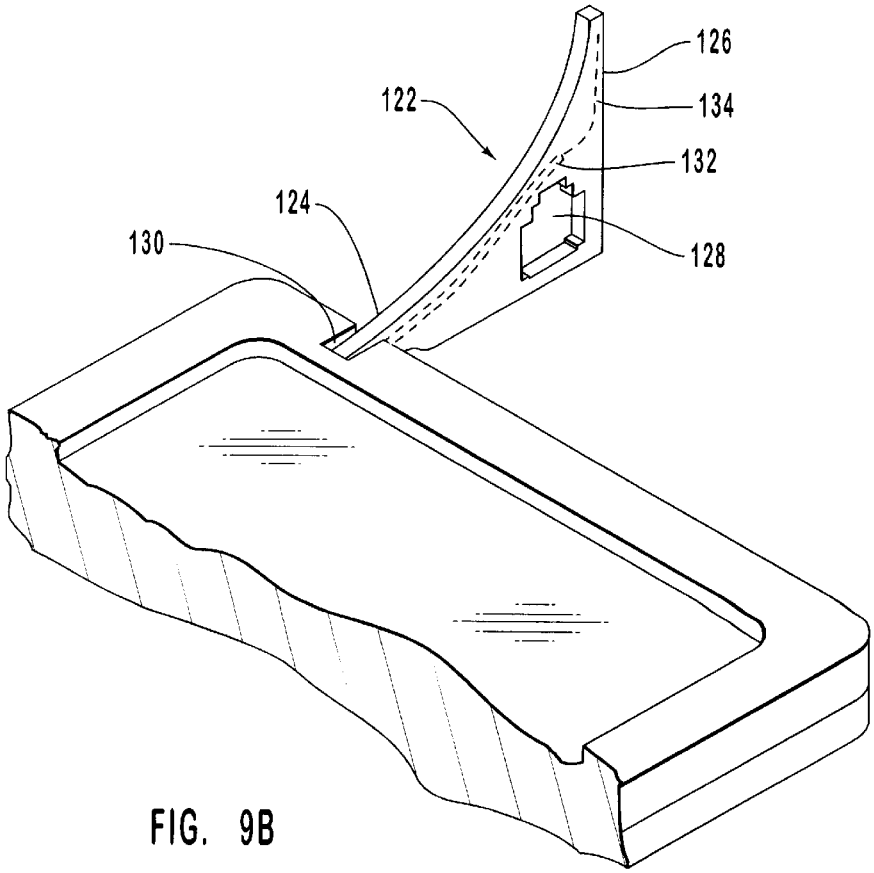
FIG. 9B is a perspective view of a palm computing device with an embodiment of the present invention comprising a swivel mounted antenna with integral cable connector in a deployed position.

In reference to FIGS. 9A and 9B, a fifth embodiment of the present invention is shown in conjunction with a palm computing device 120. Extension 122 extends from palm device 120 on a rotatable and retractable attachment 124. Once extension 122 is extended from a position internal to palm device 120, extension 122 may be rotated so as to position antenna 126 in a substantially vertical orientation. Physical/electrical media connector or cable connector 128 may be accessed in either antenna position. This embodiment may further comprise switching circuitry which activates a wireless device when antenna 126 is oriented substantially vertically and deactivates the wireless device when antenna 126 is oriented substantially horizontally. Wired devices which use connector 128 may also be activated and deactivated alternatively. Once extension 122 has been rotated to orient antenna 126 in a vertical orientation, extension 122 may be partially or fully retracted by retracting all or part of extension 122 into slot 130. Slot 130 may provide structural support and protection for extension 122 and allow palm device 120 to have a smaller size format while antenna 126 is deployed. Retraction into slot 130 may also activate switching mechanisms or circuitry which may activate or deactivate devices in palm computing device 120.

Transmission line and switching circuit connections as well as cable connector conductors, conductive elements for a ground plane and impedance matching circuitry may be internal to extension 122. Some of these elements may increase interference for antenna 126. Some of this interference and some external interference may be shielded by using a micro-coaxial transmission line cable 132 for antenna 126. This micro-coaxial cable may be located internal to extension 122 and will electrically connect to a radiating element 134 for antenna 126.

Figure 10A:
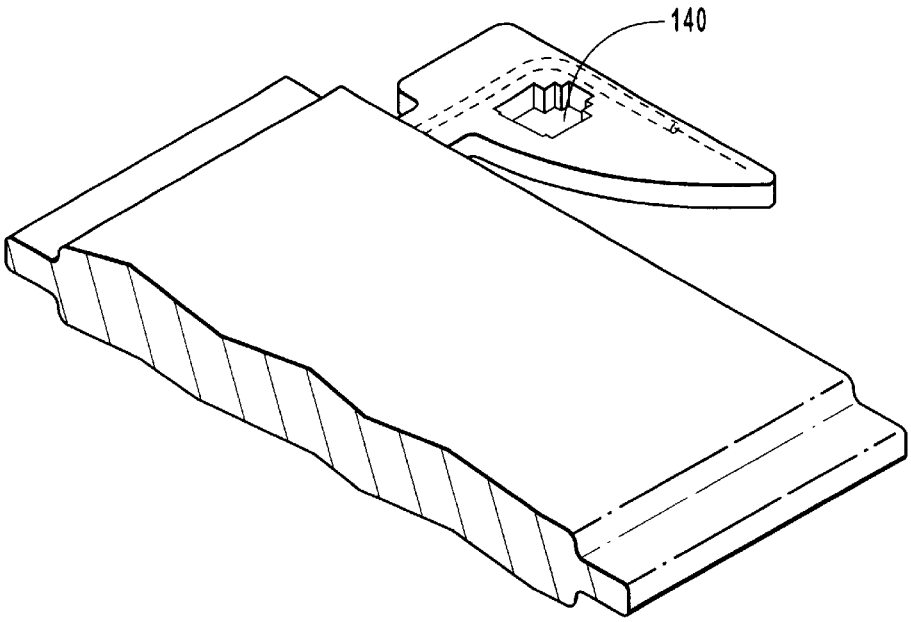
FIG. 10A is a perspective view of a PC Card standard expansion card with an embodiment of the present invention in an extended, but undeployed position.
Figure 10B:
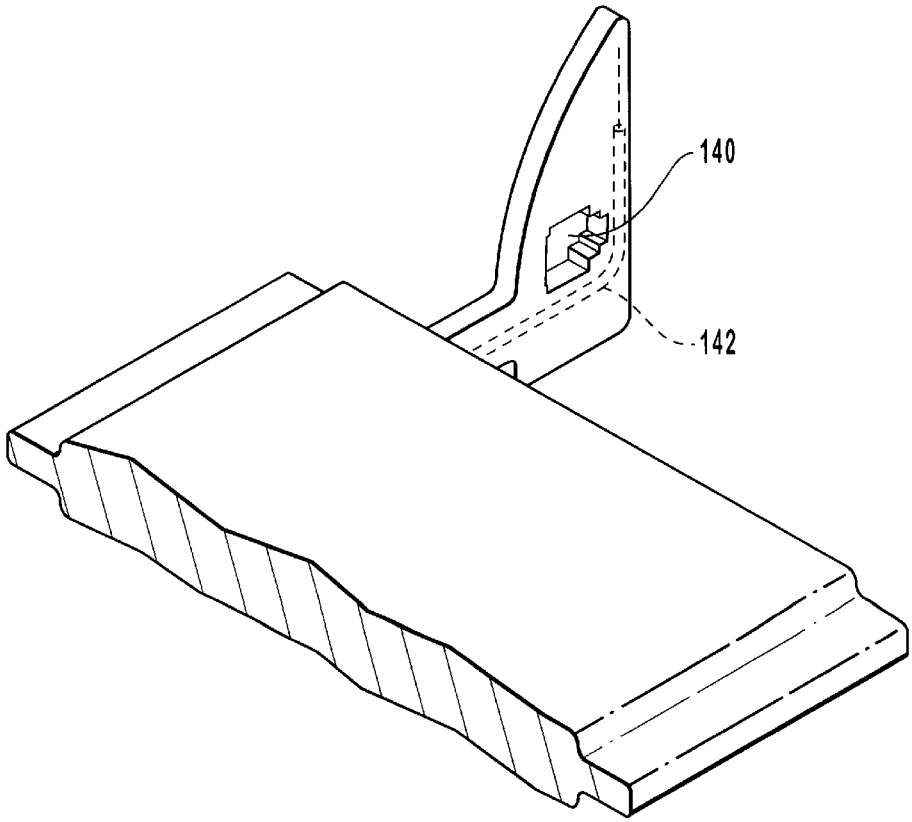
FIG. 10B is a perspective view of a PC Card standard expansion card with an embodiment of the present invention in an extended and deployed position.

It should be noted by reference to FIGS. 10A and 10B, showing a sixth embodiment of the present invention, and other figures, showing other embodiments, that physical/electrical media connector or cable connector 140 may be disposed in several orientations and configurations. Connector 140 may be located on either side of coaxial transmission line 142 and may be rotated as needed to best fit spacial constraints.

It should also be noted that the shape of the various extensions and antennas of different embodiments of the present invention may vary widely. Many embodiments shown herein comprise modified monopole shaped antennas and extensions. These are merely exemplary of the various antenna designs and configurations which may be used in the present invention.

Figure 11A:
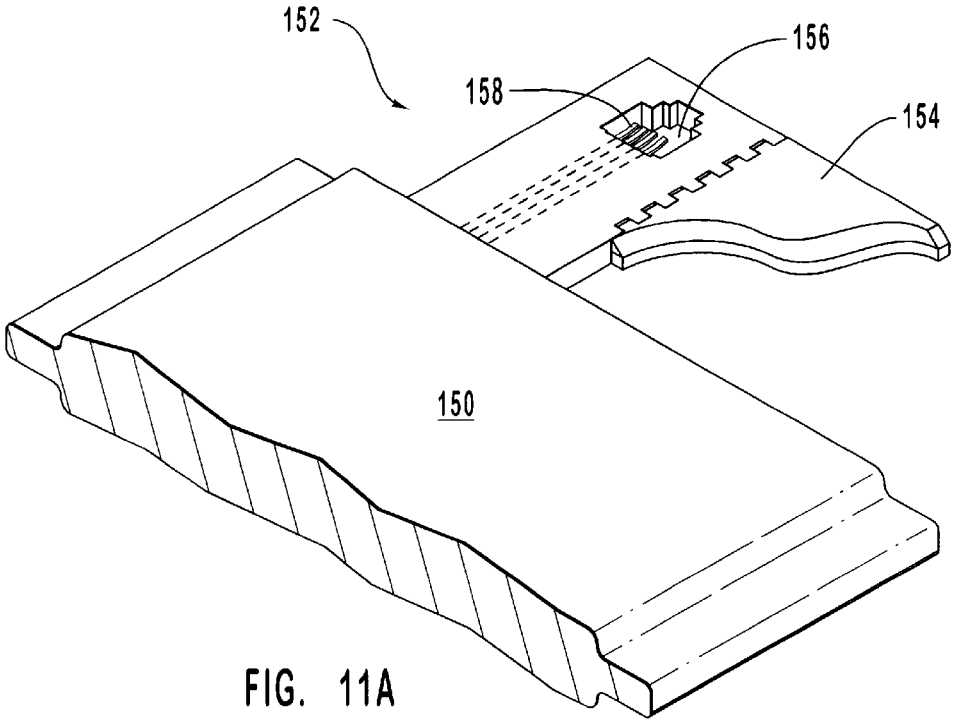
FIG. 11A is a perspective view of an embodiment of the present invention comprising a hinged antenna and adjacent cable connector with the antenna in a stowed position.
Figure 11B:
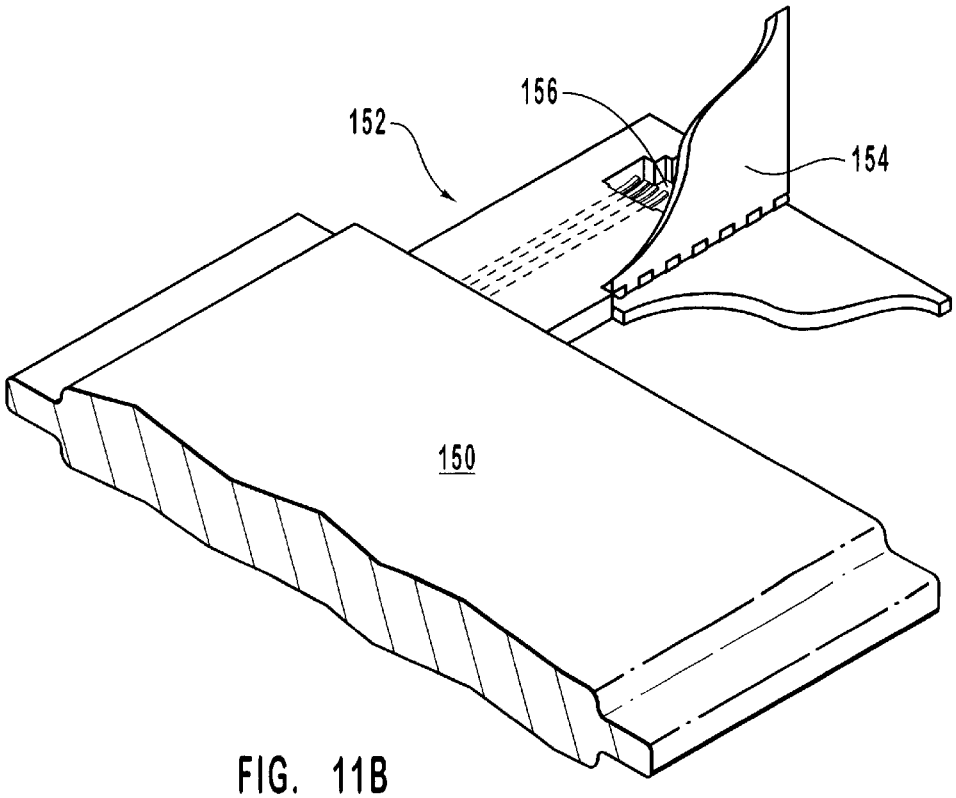
FIG. 11B is a perspective view of an embodiment of the present invention comprising a hinged antenna and adjacent cable connector with the antenna in a deployed position.

FIGS. 11A and 11B show a seventh embodiment of the present invention with a host device 150 and extension 152. This embodiment comprises a hinged antenna 154 with an adjacent cable connector 156. Cable connector 156 may be accessed while antenna 154 is in either a stowed or deployed position. Cable connector may be oriented in almost any position, however, a position which places connector conductors 158 most proximate to host device 150 will generally provide a more economical and efficient connection.

Figure 12A:
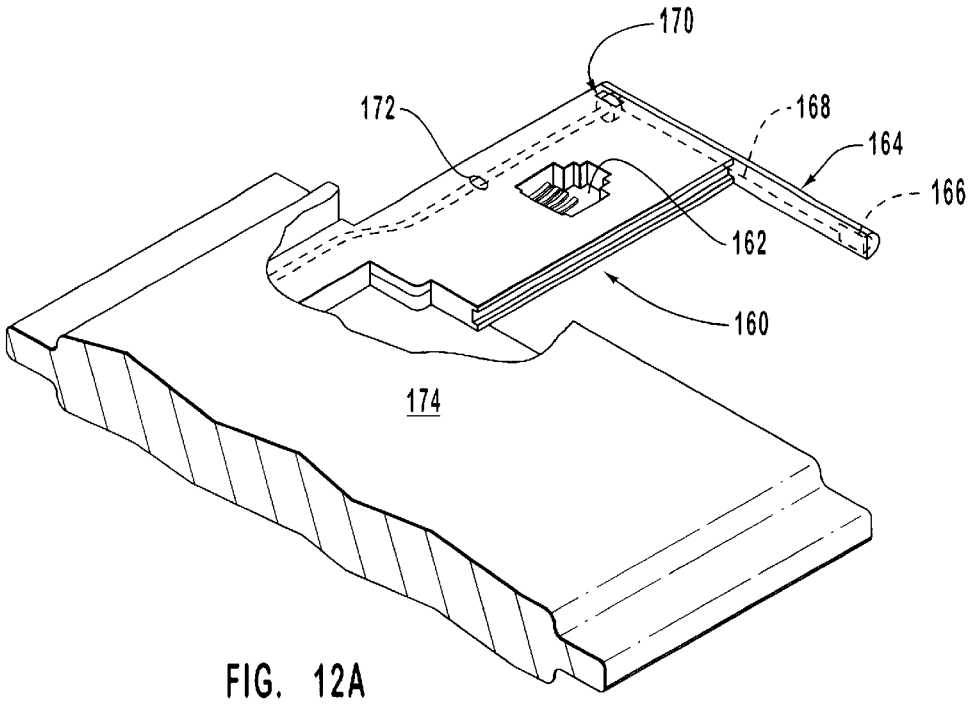
FIG. 12A is a perspective view of an embodiment of the present invention comprising a hinged whip antenna and cable connector with the antenna in a stowed position.
Figure 12B:
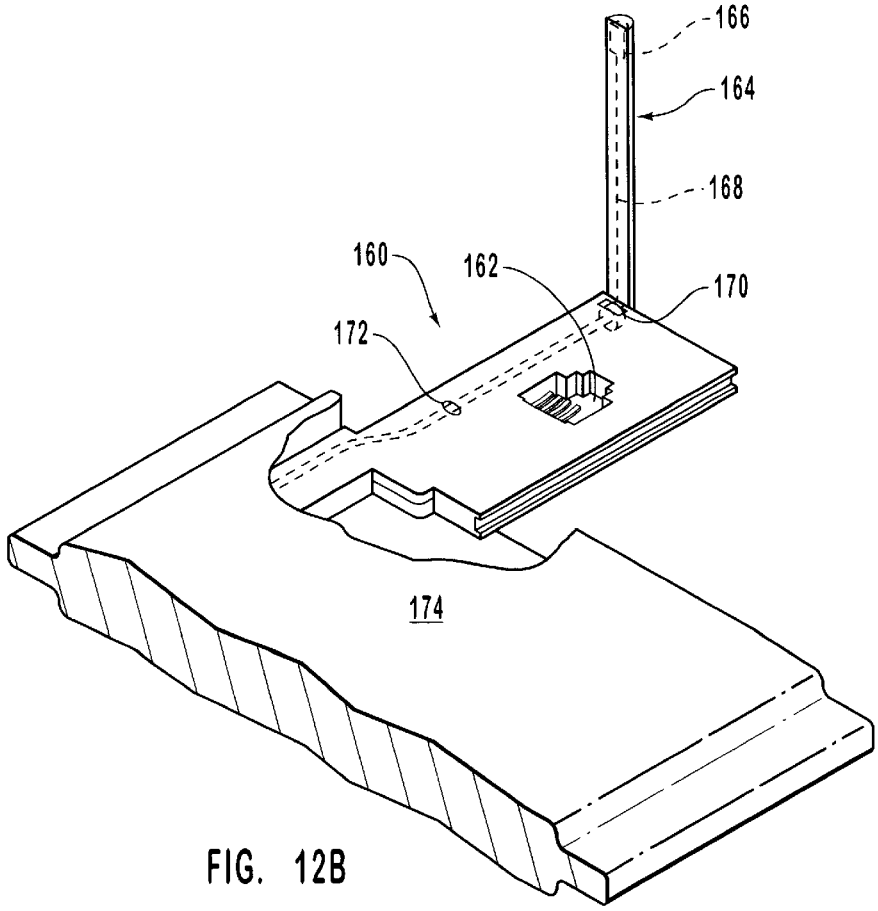
FIG. 12B is a perspective view of an embodiment of the present invention comprising a hinged whip antenna and cable connector with the antenna in a deployed position.

In reference to FIGS. 12A and 12B, an eighth embodiment of the present invention comprises a retractable extension 160 with a physical/electrical media connector 162 therein. Extension 160 further comprises a rotatable whip antenna 164. Antenna 164 may comprise chip antenna circuitry 166 or another antenna configuration which is connected to apparatus 174 by cable or wire 168 which may or may not be part of a radiating element. Cable or wire 168 extends through hinged connection 170 and electrically connects to shielded cable 172 which extends past cable connector 162 and into apparatus 174 to make an electrical connection thereto. Antenna 164 may be hinged from a stowed position as shown in FIG. 12A to a deployed position as shown in FIG. 12B. As in other embodiments of the present invention, extension 160 may comprise ground plane elements as well as impedance matching circuitry, switching circuitry or other circuitry or mechanisms.

Figure 13A:
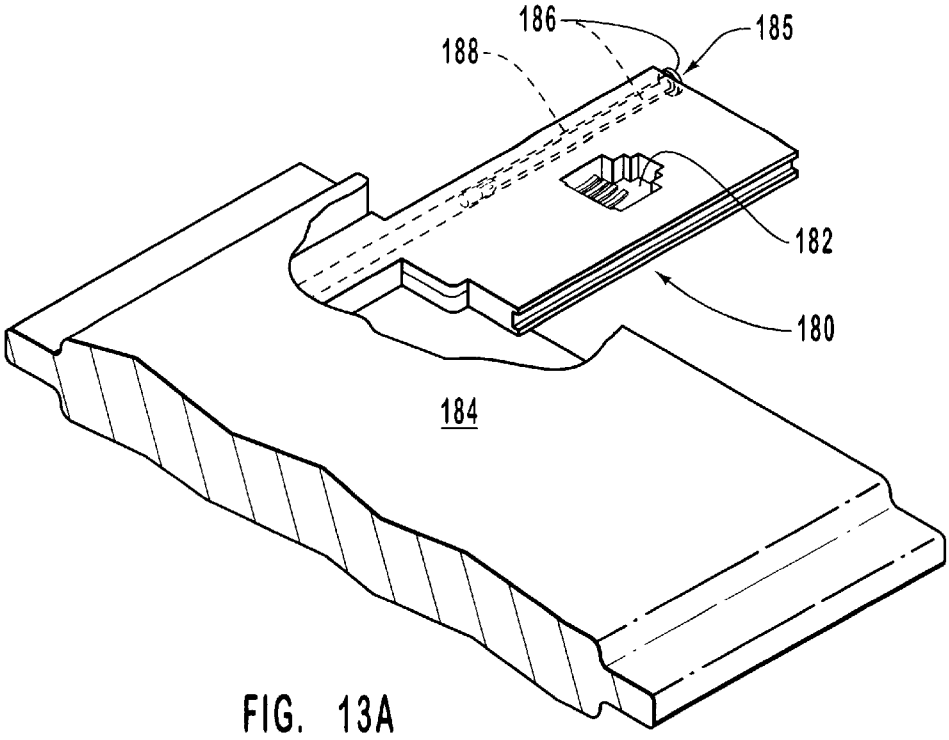
FIG. 13A is a perspective view of an embodiment of the present invention comprising a retractable whip antenna which extends from a retractable cable connector with the antenna in a stowed position.
Figure 13B:
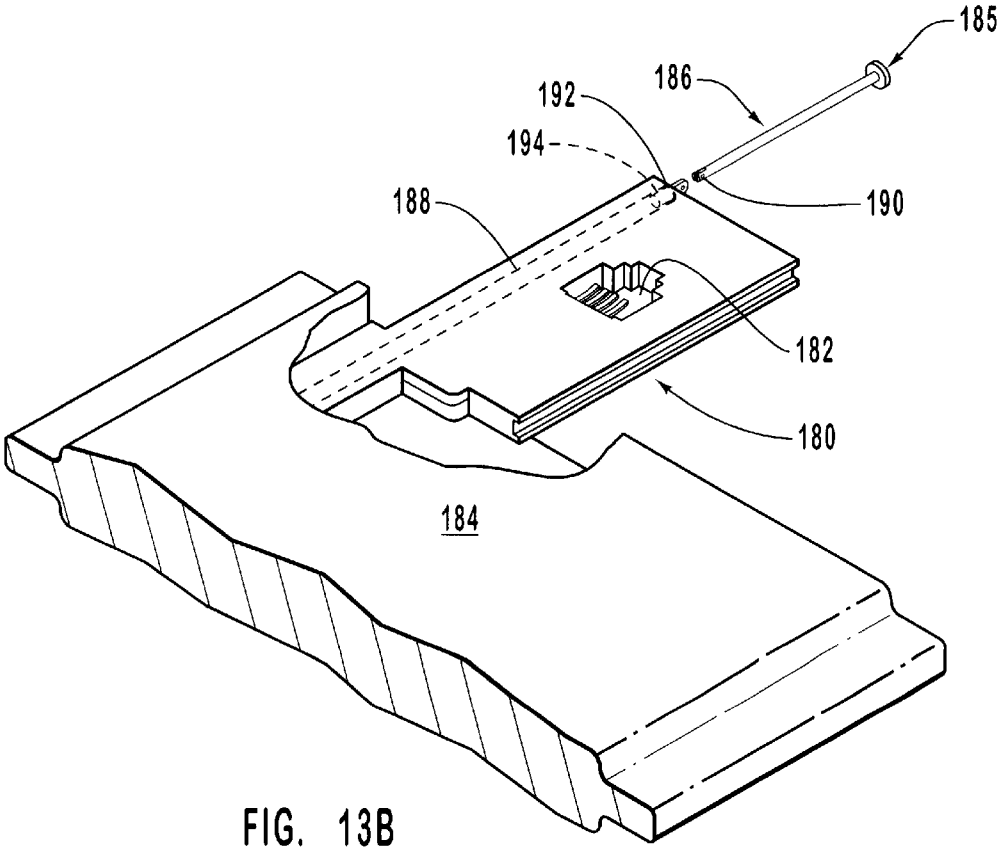
FIG. 13B is a perspective view of an embodiment of the present invention comprising a retractable whip antenna which extends from a retractable cable connector with the antenna in an extended position.

A ninth embodiment of the present invention, as shown in FIGS. 13A and 13B, comprises an extension 180 in an electronic apparatus 184 which comprises a cable connector 182 as well as and antenna 186. Antenna 186 may be fully stowed within extension 180, as shown in FIG. 13A where antenna 186 is retracted into tube 188 within extension 180. Tube 188 may be composed of many materials, however, preferable materials will provide electrical insulation and will allow tube 188 to bend and flex around obstacles which may be found in extension 180 and apparatus 184. Antenna 186 may also be constructed of flexible materials so that it may conform to a non-linear path of tube 188 when antenna 186 is retracted therein.

Figure 13C:
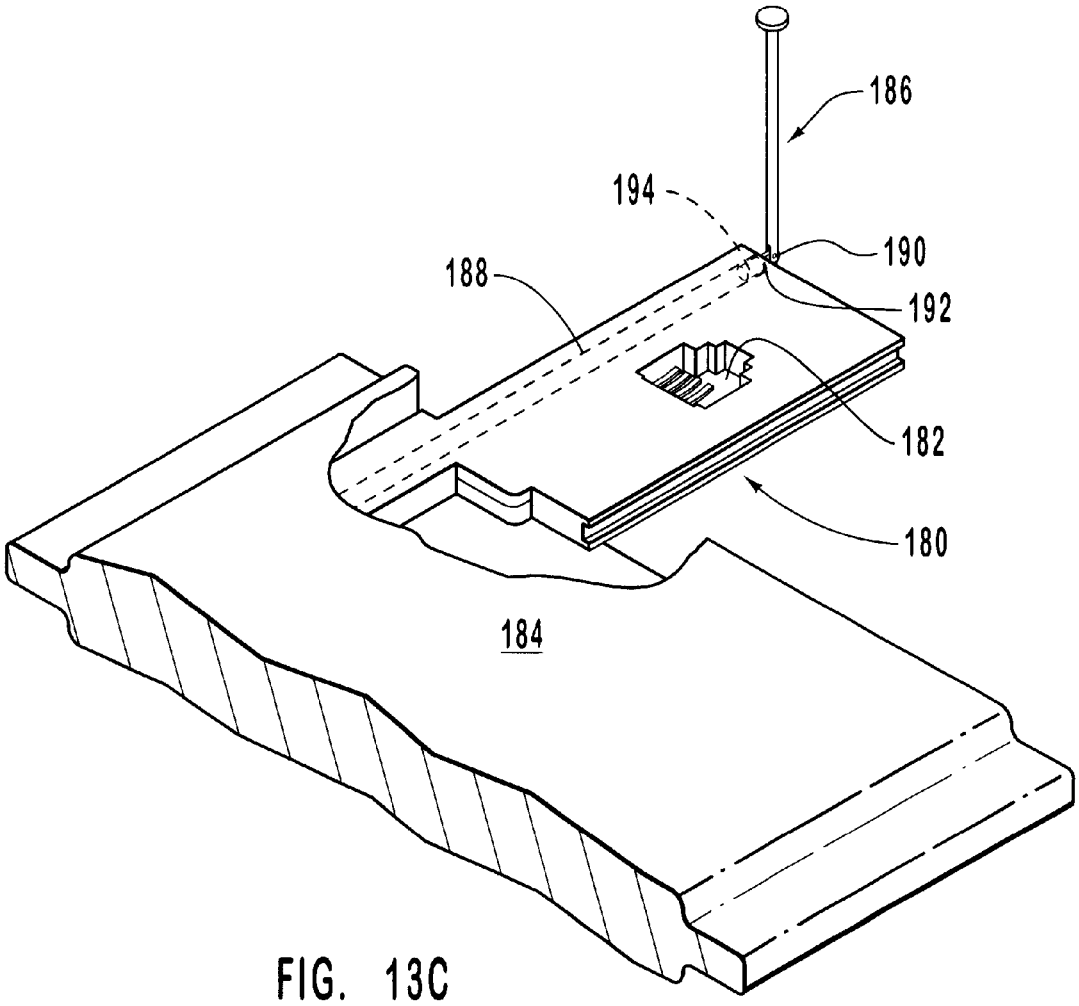
FIG. 13C is a perspective view of an embodiment of the present invention comprising a retractable whip antenna which extends from a retractable cable connector with the antenna in a fully deployed position.

Antenna 186 may be extended from tube 188 by pulling on tip 185 which is exposed from the end of extension 180. When antenna 186 is fully extended from extension 180, as shown in FIG. 13B, antenna hinge 190 becomes exposed and is free to rotate antenna 186 into a vertical position as shown in FIG. 13C. Antenna base 194 may be directly connected to a flex cable which extends into apparatus 184 or it may make electrical contact with a fixed contact 192 within extension 180 which, in turn, connects to apparatus 184. Other connection variations are also possible and are to be considered to be within the scope of the present invention.

The commonly used miniature 8-pin and miniature 6-pin connectors known in the art are typically used in applications that require only 2 to 4 pins. The additional pins are typically not necessary and often go unused. Embodiments of the present invention use these unused conductors for additional functionality. Some of the unused conductors may be used as transmission line conductors for the antenna leads. Additional conductors may be used to perform switching operations whereby circuitry in a device or expansion card is activated or deactivated according to the position of the antenna within the device's jack. In one embodiment comprising a combination wireless LAN adapter and a wired LAN adapter, previously unused conductors are used to switch between the wireless circuitry which is activated when an antenna is inserted into the jack and wired circuitry which is activated when the antenna is removed from the jack. Switching and activation may utilize a pull-up resistor configuration to accomplish this task. Other circuitry may also be used and digital circuitry, including multiplexor adaptations, may be used. A combination wireless modem and wired modem may also used this switching circuitry as may other devices.

Impedance matching circuitry may also be located within the antenna, extension, other elements or on the host device.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. An electronic apparatus comprising:

a physical/electrical media connector; and a modified monopole antenna having a radiating element protruding substantially vertically from said connector and having a top edge curving away horizontally from circuitry in said electronic apparatus then curving back vertically, said antenna being physically combined with said connector to form a single unit.

2. The electronic apparatus of claim 1 wherein said connector is a thin profile jack that accepts a miniature 6-pin plug.

3. The electronic apparatus of claim 1 wherein said connector is a thin profile jack that accepts a miniature 8-pin plug.

4. The electronic apparatus of claim 1 wherein said connector is a thin profile jack.

5. The electronic apparatus of claim 1 wherein said connector is a retractable thin profile jack.

6. The electronic apparatus of claim 1 wherein said apparatus is an expansion card.

7. The electronic apparatus of claim 1 wherein said apparatus is a PC Card standard expansion card.

8. The electronic apparatus of claim 1 wherein said antenna is deployable from said single unit.

9. The electronic apparatus of claim 8 wherein said antenna is deployed by hinging from a substantially horizontal position to a substantially vertical position.

10. The electronic apparatus of claim 1 wherein further comprising a combination wireless computer network adapter and a cable-connected computer network adapter.

11. The electronic apparatus of claim 1 wherein said antenna is a chip antenna.

12. An antenna comprising:

a radiating and receiving element; and a physical/electrical media connector, said connector and said radiating and receiving element being physically combined in a single unit wherein said single unit comprises a ground plane for said antenna and said antenna has a centroidal position on said ground plane.

13. The antenna of claim 12 wherein said radiating and receiving element is configured to operate in a range around 2.4 GHz.

14. The antenna of claim 12 wherein said antenna is selected from a group consisting of a monopole antenna, a dipole antenna, a patch antenna, and a chip antenna.

15. The antenna of claim 12 wherein said antenna is a modified monopole antenna.

16. The antenna of claim 12, wherein said single unit comprises said ground plane for said antenna.

17. An electronic apparatus comprising:

a retractable physical/electrical media connector, said connector being capable of moving from a retracted position interior to said electronic apparatus to an extended position exterior to said electronic apparatus and wherein said connector comprises at least a partial ground plane for said antenna; and an antenna which is physically combined with said connector into a single unit, said antenna being a modified monopole antenna having a radiating element protruding substantially vertically from said ground plane element and having a top edge curving horizontally away from electronic apparatus circuitry then curving back vertically.

18. The apparatus of claim 17 wherein said retractable connector has a thickness smaller than a cross-sectional dimension of a complementary connector configured to connect therewith.

19. The apparatus of claim 17 wherein said antenna has a centroidal position on said ground plane.

20. The apparatus of claim 17 wherein the modified monopole antenna generally comprises a thin "fin" having a first and second substantially planar surface opposite each other and connected by a substantially vertical edge.

21. The electronic apparatus of claim 17 wherein said connector is a thin profile jack.

22. The electronic apparatus of claim 17 wherein said connector is a thin profile jack that accepts a miniature 6-pin plug.

23. The electronic apparatus of claim 17 wherein said connector is a thin profile jack that accepts a miniature 8-pin plug.

24. The electronic apparatus of claim 17 wherein said apparatus is an expansion card.

25. The electronic apparatus of claim 17 wherein said apparatus is a PC Card standard expansion card.

26. The electronic apparatus of claim 17 wherein said antenna is deployable from said single unit.

27. The electronic apparatus of claim 17 wherein said antenna is deployed by hinging from a substantially horizontal position to a substantially vertical position.

28. The electronic apparatus of claim 17 further comprising a combination wireless computer network adapter and a cable-connected computer network adapter.

29. The electronic apparatus of claim 17 wherein said antenna is a chip antenna.

* * * * *